US005564867A

United States Patent [19]

Domanski et al.

[11] Patent Number: 5,564,867

[45] Date of Patent: Oct. 15, 1996

[54] RESILIENTY COMPRESSIBLE SUPPORT COLUMN FOR USE IN A MINE

[75] Inventors: Lothar Domanski, Oberhausen; Rudi Podjadtke, Herne, both of Germany

[73] Assignee: Bochumer Eisenhutte Heintzmann GmbH & Co. KG, Bochum, Germany

[21] Appl. No.: 330,712

[22] Filed: Oct. 28, 1994

[30] Foreign Application Priority Data

Nov. 13, 1993 [DE] Germany ..... 43 38 830.2

[51] Int. Cl.[6] ..... E21D 15/26

[52] U.S. Cl. ..... 405/290; 248/354.3

[58] Field of Search ..... 405/290, 288; 248/354.3, 354.1, 354.7, 354.6

[56] References Cited

U.S. PATENT DOCUMENTS

| | | | |
|---|---|---|---|
| 568,471 | 9/1896 | Ball | 248/354.3 |
| 2,705,605 | 4/1955 | Kreissig et al. | 248/354.3 |
| 3,737,134 | 6/1973 | Foon | 248/354 |
| 4,185,940 | 1/1980 | Spies | 405/288 |
| 4,249,837 | 2/1981 | Spies | 405/290 |
| 4,966,345 | 10/1990 | Bersier | 248/354.3 |
| 5,015,125 | 5/1991 | Seegmiller | 248/354.1 X |
| 5,314,161 | 5/1944 | Domanski et al. | 248/354.3 |
| 5,400,994 | 3/1995 | Shawwaf et al. | 248/354.3 |

FOREIGN PATENT DOCUMENTS

| | | | |
|---|---|---|---|
| 217549 | 10/1958 | Australia | 248/354.3 |
| 703064 | 2/1941 | Germany . | |
| 721529 | 6/1942 | Germany . | |
| 724856 | 9/1942 | Germany | 248/354.1 |
| 1049813 | 2/1959 | Germany . | |
| 2078822 | 1/1982 | United Kingdom | 405/290 |

*Primary Examiner*—Hoang C. Dang

*Attorney, Agent, or Firm*—Herbert Dubno; Andrew Wilford

[57] ABSTRACT

An adjustable support column for use between ceiling and floor surfaces of a mine has an outer tube having an outer end braced against one of the surfaces and an inner end and an inner tube having an inner end in the outer tube at the inner end thereof and an outer end braced against the other surface. The tubes are coaxial to an upright axis and a wedge ring carried externally on the inner tube is tapered toward the outer tube and engageable in the inner end of the outer tube for resiliently resisting telescoping of the inner tube into the outer tube with a predetermined force and for permitting telescoping of the inner tube into the outer tube when the tubes are pressed axially together with a force greater than the predetermined force. Formations on the inner tube engage the ring for axially displacing the ring along the inner tube and fix the ring on the inner tube at any of a multiplicity of locations therealong.

9 Claims, 2 Drawing Sheets

RESILIENTY COMPRESSIBLE SUPPORT COLUMN FOR USE IN A MINE

FIELD OF THE INVENTION

The present invention relates to a support column for use in a mine. More particularly this invention concerns such a column which is resiliently compressible.

BACKGROUND OF THE INVENTION

A standard column or prop used in a mine to hold up the ceiling or roof comprises a pair of aluminum or steel tubular tubes that telescope in each other. The outer end of one of the tube is braced against the ceiling surface and the outer end of the other tube is braced against the floor surface while the inner ends fit within each other. As described in U.S. Pat. Nos. 3,737,134 and 4,185,940 respectively of Foon and Spies the upper end of the outer tube is frustoconically upwardly flared and annular wedges engage between this flared region and the inner tube. These wedges allow the tubes to be moved axially apart but resist movement together as the wedges bite into the inner tube. The wedges permit some downward movement of the inner tube in the outer tube, giving the column its vertical resiliency. The upper end of the inner tube is formed as a nut into which is threaded a massive bolt whose upper end bears via a rigid dished plate on the ceiling, this plate having no significant resiliency. The setting force, that is the vertical load the column is set to bear, is established by screwing this bolt out of the column against the ceiling.

The wedges allow the prop to be compressed vertically to a limited extent if the ceiling or floor shifts. Thus for a slight shift the prop will not collapse but will remain in place. Once the column has shortened somewhat, it becomes solid and resists any further shortening. Thus such a prop acts like a pressure-relief valve.

With such systems it is fairly difficult to set the starting post length, which determines the setting force, accurately and easily. Normally the parts that establish this post length (and the setting force) are independent of the elements that provide for resiliently resisted telescoping together. Thus the known props are excessively complex and expensive, which is particularly disadvantageous since they are normally set and left, that is they cannot easily be reused.

OBJECTS OF THE INVENTION

It is therefore an object of the present invention to provide an improved resilient support column for a mine.

Another object is the provision of such an improved resilient support column for a mine which overcomes the above-given disadvantages, that is which is of relatively simple and inexpensive construction, but that can be set up and used easily.

SUMMARY OF THE INVENTION

An adjustable support column for use between ceiling and floor surfaces of a mine has according to the invention an outer tube having an outer end braced against one of the surfaces and an inner end and an inner tube having an inner end in the outer tube at the inner end thereof and an outer end braced against the other surface. The tubes are coaxial to an upright axis and a wedge ring carried externally on the inner tube is tapered toward the outer tube and engageable in the inner end of the outer tube for resiliently resisting telescoping of the inner tube into the outer tube with a predetermined force and for permitting telescoping of the inner tube into the outer tube when the tubes are pressed axially together with a force greater than the predetermined force. Formations on the inner tube engage the ring for axially displacing the ring along the inner tube and fix the ring on the inner tube at any of a multiplicity of locations therealong.

Thus with this system the same mechanism serves both for providing the resilience of the column and for establishing its starting out length and setting force. Normally according to the invention the inner tube is below the outer tube and the outer-tube outer end has a head engaging the ceiling surface and the inner-tube outer end has a foot engaging the floor surface. The wedge ring is carried on a support ring and the formations are interengaging screwthreads or teeth on the support ring and inner tube. With a threaded support ring a torque wrench can be used on the support ring to set the desired compression in the column, since the torque applied to the support ring is directly related to the axial compression of the column. When the support ring is secured via teeth on the inner tube, the teeth can be sawtooth shaped to allow one-way sliding of the support ring on the inner tube.

The inner tube is provided with a stop limiting axial displacement of the tubes relative to each other. This stop can be formed by the support ring which may be unitary with the wedges or wedge ring. In addition according to the invention the wedge ring includes a plurality of segments and an annular clamp securing same on the inner tube. This clamp can be a hose clamp, sleeve, nut, or the like.

To increase the resistance to axial compression the outer tube is provided internally with a mass of compressible material engageable with the inner tube, for instance foamed plastic, foamed concrete, or even wood. To increase the stiffness even more the inner-tube inner end provided with a closure plate engaging the mass like the head of a piston. This mass can be created by a cartridge activatable to create the mass. The cartridge can have two compartments separated by a membrane. One of the compartments holds a material that, when mixed with that of the other compartment, foams up into a mass that cures hard. Means is provided for rupturing a membrane between the compartments and mixing the materials to activate the cartridge and fill the interior of the outer tube with a mass that gets fairly hard.

In accordance with further features of this invention the outer end engaging the ceiling surface is provided with a head filled with a compressible mass. Similarly, the outer end engaging the floor surface is provided with a foot filled with a compressible mass. Such a system is described in related U.S. patent application Ser. No. 08/330,714 filed Oct. 28, 1994.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
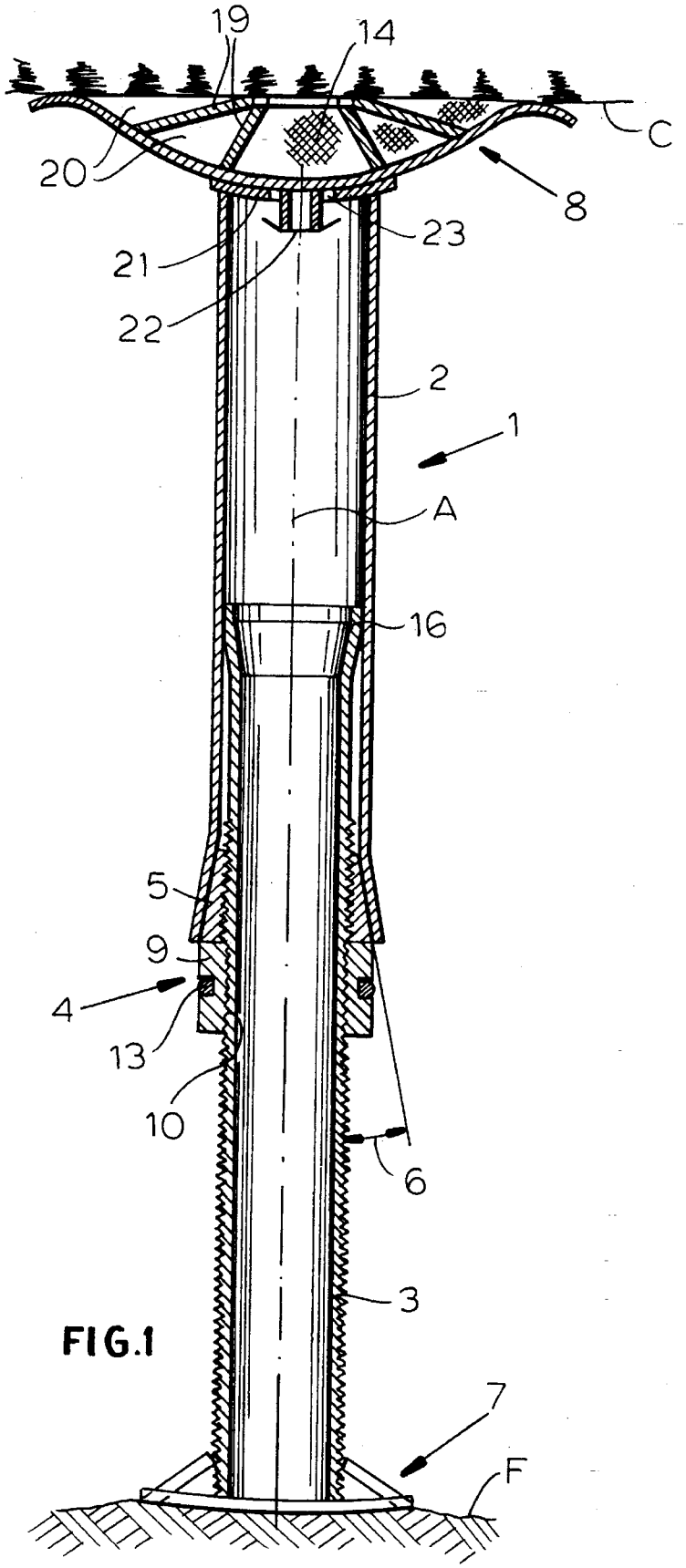
FIG. 1 is a small-scale side view in vertical section through the column according to the invention.

As seen in FIG. 1 a support column 1 according to the invention is centered on an upright axis A and extends between a floor surface F and a ceiling surface C. The column 1 is comprised of a large-diameter outer tube 2 and a smaller-diameter inner tube 3 that telescope together along the axis A. A retaining assembly 4 including a wedge ring 5 is secured between the lower or inner end of the upper tube 2 and the upper inner end of the lower tube 3. The lower end of the upper tube 2 is flared frustoconically outward at an angle 6 corresponding to that of the wedge ring 5 that fits between it and the inner tube 3. The lower end of the inner tube 3 has a foot 7 that supports it on the floor surface F and the upper end of the outer tube has a head 8 bearing on the ceiling surface C. The upper end of the inner tube 3 is guided by formations 16 inside the outer tube 2.

Figure 2:
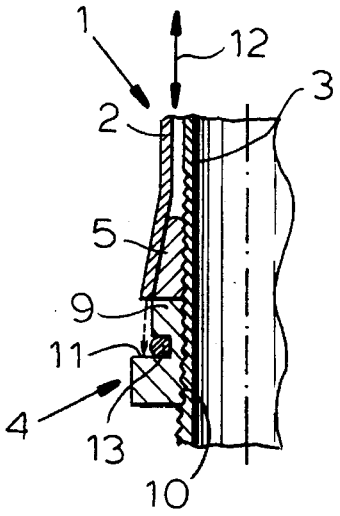
FIG. 2 is a detail view of a variation on the system of FIG. 1.

The retaining assembly 4 includes a ring 9 secured by screwthreads 10 to the outer surface of the outer tube 3 so as to be axially movable therealong, but so it can also be positioned solidly against moving on this tube 3. The ring 9 is actually formed of several parts held together by an annular clamp 13. This ring 9 may be formed as shown in FIG. 2 with an upwardly directed shoulder 11 against which the lower end of the tube 2 can abut when the tube 2 moves axially downward as indicated by arrow 12. Thus this shoulder 11 forms a solid end stop for movement of the tube 2 on the tube 3.

The upper end of the column 1 is provided with a part spherical seat plate 21 in which sits a part-spherical disk forming the head 8 and provided internally with webs 19 forming chambers 20 filled with an elastomeric mass 14. The head 8 has a downwardly directed pin 22 passing with play through a central hole 23 in the seat 21 so that this head 8 can rock limitedly on the column 1.

Such a support post 1 is set vertically in position. The support ring 9 is screwed up until the head 8 engages the roof or ceiling surface C. Then a torque wrench is fitted to the ring 9 and it is turned further to a predetermined torque, which will be directly proportional to the axial compression of the support column 1. If the ceiling drops somewhat the wedge ring 5 will be driven up into the tube 2, deforming it outwardly and resisting such movement with the force it takes to deform the outer tube 2. When the lower end of the outer tube 2 abuts the surface 11 in the embodiments of FIGS. 2 through 4, such axial shortening comes to an end.

Figure 3:
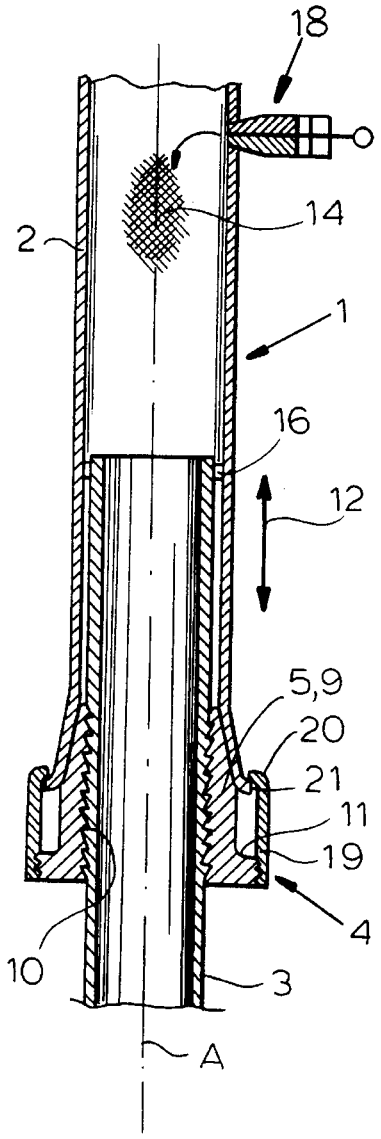
FIG. 3 is a vertical section through the center region of another support column according to the invention.

It is also possible as shown in FIG. 3 for the wedge ring 5 and support ring 9 to be united into a single part. In addition it is possible to inject into the interior of the column 1 a mass 14 of hardenable compressible elastomeric material with a device such as indicated at 18. FIG. 3 also shows a stop sleeve 19 screwed onto the ring 5, 9 and having an inwardly turned upper edge 20 that engages over an outwardly turned lower edge 21 of the tube 2 to limit displacement of the tube 2 away from the tube 3, primarily prior to assembly. Thus when the column 1 of FIG. 3 is compressed axially the upper end of the tube 3 will cut into the mass 14.

Figure 4:
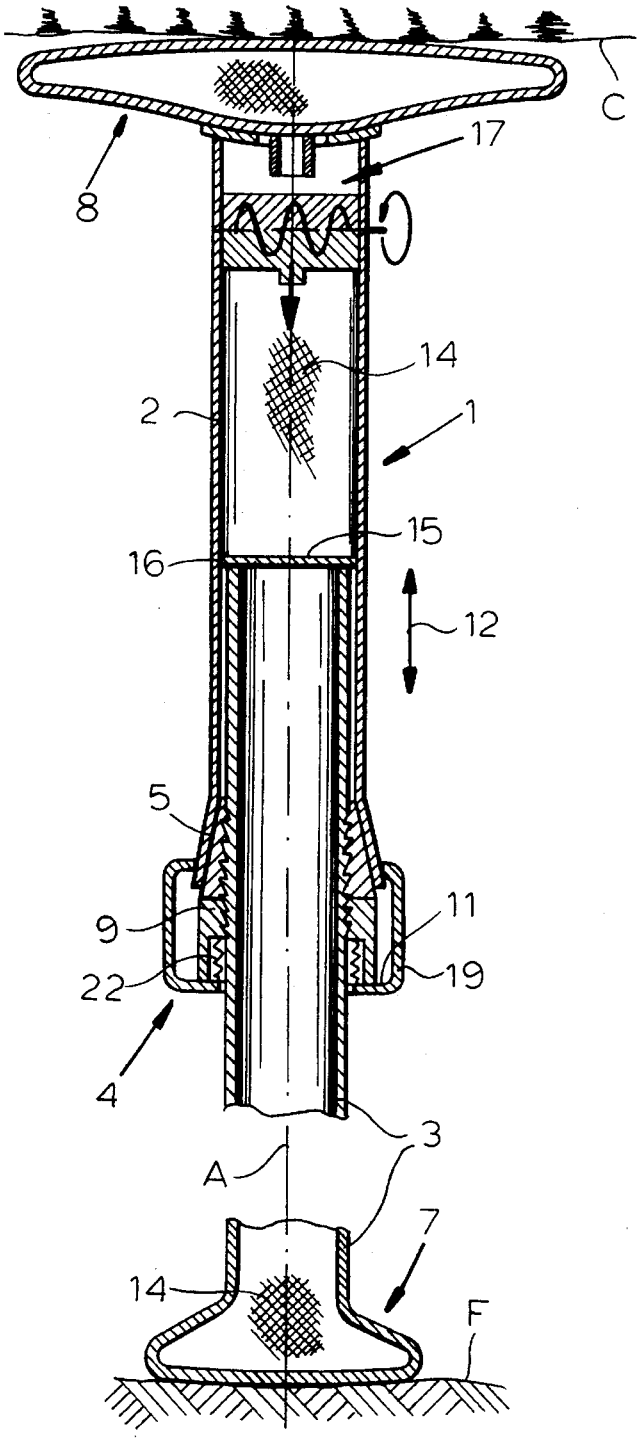
FIG. 4 is a small-scale vertical section through yet another column according to the invention.

In FIG. 4 the upper end of the tube 3 is closed by a plate 15 which compresses the mass 14 which is created in part by an externally actuatable device 17. In addition here the sleeve 19 is not threaded on the ring 9, but instead is axially slidable thereon and is biased downward by springs 22. Furthermore here the foot 7 is also filled with the mass 14.

We claim:

1. An adjustable support column for use between ceiling and floor surfaces of a mine, the column comprising:

an outer tube having an outer end provided with a head braced against the ceiling surface and an inner end;

an inner tube below the outer tube and having an inner end in the outer tube at the inner end thereof and an outer end provided with a foot braced against the floor surface, the tubes being coaxial to an upright axis;

means including a wedge ring carried externally on the inner tube, tapered toward the outer tube, and engageable in the inner end of the outer tube and a support ring fixed axially externally on the inner tube and bearing axially on the wedge ring for resiliently resisting telescoping of the inner tube axially over the wedge ring into the outer tube with a predetermined force and for permitting telescoping of the wedge ring into the outer tube when the wedge ring is pressed axially into the outer tube with a force greater than the predetermined force; and interengaging screwthreads on the inner tube and the support ring for axially displacing the rings along the inner tube and fixing the rings on the inner tube at any of a multiplicity of locations therealong.

2. The adjustable mine support column defined in claim 1 wherein the means further includes a stop limiting axial displacement of the tubes relative to each other.

3. The adjustable mine support column defined in claim 1 wherein the ring includes a plurality of segments and an annular clamp securing same on the inner tube.

4. The adjustable mine support column defined in claim 1 wherein the outer tube is provided internally with a mass of compressible material engageable with the inner tube.

5. The adjustable mine support column defined in claim 4 wherein the inner-tube inner end is provided with a closure plate engaging the mass.

6. The adjustable mine support column defined in claim 1 wherein the outer tube is provided with a cartridge activatable to create the mass.

7. The adjustable mine support column defined in claim 1 wherein the head is filled with a compressible mass.

8. The adjustable mine support column defined in claim 1 wherein the foot is filled with a compressible mass.

9. An adjustable support column for use between ceiling and floor surfaces of a mine, the column comprising:

an outer tube having an outer end braced against one of the surfaces and an inner end;

an inner tube having an inner end in the outer tube at the inner end thereof and an outer end braced against the other surface, the tubes being coaxial to an upright axis;

means including a wedge ring carried externally on the inner tube, tapered toward the outer tube, and engageable in the inner end of the outer tube and a support ring fixed axially externally on the inner tube and bearing axially on the wedge ring for resiliently resisting telescoping of the inner tube axially over the wedge ring into the outer tube with a predetermined force and for permitting telescoping of the wedge ring into the outer tube when the wedge ring is pressed axially into the outer tube with a force greater than the predetermined force; and interengaging screwthreads on the inner tube and the support ring for axially displacing the rings along the inner tube and fixing the rings on the inner tube at any of a multiplicity of locations therealong.

* * * * *